US007954279B2

(12) United States Patent
Covone et al.

(10) Patent No.: US 7,954,279 B2
(45) Date of Patent: Jun. 7, 2011

(54) FASCIA CAP FOR ROOF

(75) Inventors: Francis Thomas Covone, Deep River, CT (US); Robert Sherman Goodman, East Haven, CT (US); William Alexander Batts, III, New Haven, CT (US)

(73) Assignee: C&G Locksystem, LLC, Hamden, CT (US)

( * ) Notice: Subject to any disclaimer, the term of this patent is extended or adjusted under 35 U.S.C. 154(b) by 0 days.

(21) Appl. No.: 12/465,156

(22) Filed: May 13, 2009

(65) Prior Publication Data

US 2010/0287849 A1 Nov. 18, 2010

(51) Int. Cl.
*E04D 13/04* (2006.01)
*E04D 13/15* (2006.01)
*E04D 13/158* (2006.01)

(52) U.S. Cl. ..... 52/97; 52/58; 52/96; 52/716.2; 52/716.8; 52/741.3; 52/748.1; 52/746.11

(58) Field of Classification Search ..... 52/58, 60, 52/94, 96, 97, 836, 846, 717.06, 716.8, 800.12, 52/748.1, 746.11, 204.71, 410, 549, 741.3, 52/716.2; 428/595; 29/897.31, 897.312
See application file for complete search history.

(56) References Cited

U.S. PATENT DOCUMENTS 973,902 A * 10/1910 Woerheide ..... 52/549
1,055,848 A * 3/1913 Woerheide ..... 442/35
1,101,896 A * 6/1914 Woerheide ..... 52/549
1,102,871 A * 7/1914 Carroll ..... 52/549
1,114,467 A * 10/1914 Goddland et al. ..... 52/482
1,148,260 A * 7/1915 Stansbury ..... 52/549
1,148,647 A * 8/1915 Yetter ..... 52/549
1,187,532 A * 6/1916 Kettelson ..... 52/549
1,336,118 A 4/1920 Wright
1,723,158 A 7/1928 Guy
1,692,401 A * 11/1928 Bard ..... 52/467
1,723,204 A 8/1929 Petersen
1,761,599 A * 6/1930 Topping ..... 52/549
1,882,177 A * 10/1932 Burris ..... 52/549
2,021,922 A * 11/1935 Peck ..... 52/601
2,191,500 A * 2/1940 Rosling ..... 52/202
2,276,804 A * 3/1942 Taylor et al. ..... 52/94
2,592,482 A * 4/1952 Sperry ..... 52/531
2,596,786 A * 5/1952 Norrid ..... 52/94
2,840,201 A * 6/1958 Anderson ..... 52/217
2,878,536 A * 3/1959 Becker ..... 52/202
3,242,622 A * 3/1966 Snead ..... 52/94
3,344,566 A 10/1967 Miles et al.
3,436,877 A * 4/1969 Gunning ..... 52/11
3,832,813 A * 9/1974 Hindman ..... 52/169.12
4,254,594 A * 3/1981 Hammond et al. ..... 52/11
4,299,069 A * 11/1981 Neumann ..... 52/309.4
4,519,172 A * 5/1985 Ristow ..... 52/96
4,594,820 A * 6/1986 Render ..... 52/60
4,685,261 A * 8/1987 Seaquist ..... 52/202
4,686,808 A * 8/1987 Triplett ..... 52/410
4,848,045 A * 7/1989 Nichols et al. ..... 52/60

(Continued)

*Primary Examiner* — Robert J Canfield
(74) *Attorney, Agent, or Firm* — St. Onge Steward Johnston & Reens LLC

(57) ABSTRACT

An improved roofing method and assembly having a fascia cap designed to prevent water from moving through capillary action back towards the roof. The assembly has an a elongated drip edge running back the bottom edge of the fascia cap that displaces water away from the roof, preserving the integrity of the roof and building walls below. A blocking strip attaches the fascia cap to the roof, maintaining the assembly and helping the flow of water away from the roof.

13 Claims, 5 Drawing Sheets

U.S. PATENT DOCUMENTS 5,349,804 A * 9/1994 Van Erden et al. ..... 52/746.11
5,469,671 A * 11/1995 Rathgeber et al. ..... 52/58
5,577,361 A * 11/1996 Grabek, Jr. ..... 52/543
5,586,414 A * 12/1996 Tawzer ..... 52/57
5,675,955 A * 10/1997 Champagne ..... 52/521
5,761,860 A * 6/1998 Koike et al. ..... 52/204.67
5,768,833 A * 6/1998 Golen ..... 52/202
5,996,292 A * 12/1999 Hill et al. ..... 52/202
6,035,587 A * 3/2000 Dressler ..... 52/97
6,269,597 B1 * 8/2001 Haas ..... 52/203
6,505,455 B1 * 1/2003 Georgeau ..... 52/746.11
6,578,322 B2 * 6/2003 Kintop ..... 52/96
6,725,617 B2 * 4/2004 Cox ..... 52/408
6,759,630 B1 * 7/2004 Tenute ..... 219/213
6,764,260 B1 * 7/2004 Nebesnak et al. ..... 411/82
2003/0090122 A1 * 5/2003 Meizlish ..... 296/93
2007/0074466 A1 * 4/2007 Rasmussen ..... 52/97
2007/0266657 A1 * 11/2007 Gembala ..... 52/288.1

* cited by examiner

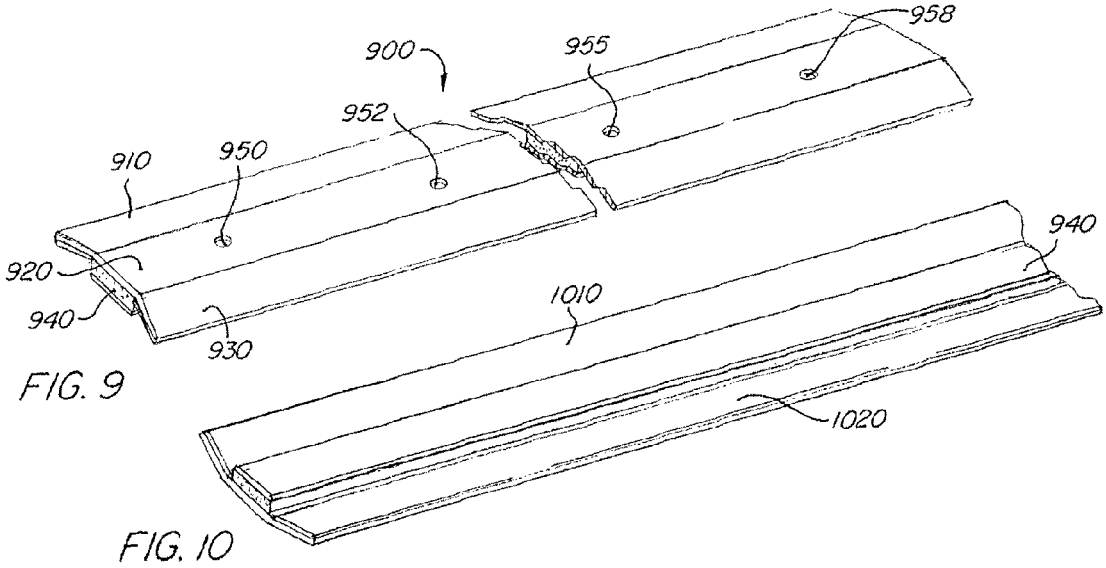
FIG. 9
FIG. 10
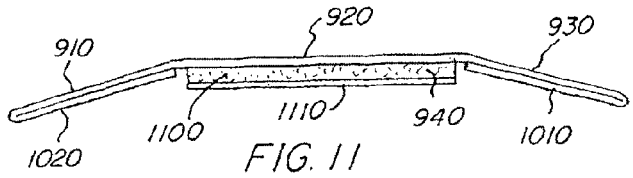
FIG. 11

FASCIA CAP FOR ROOF

FIELD OF THE INVENTION

The present invention relates to an improved fascia cap assembly for roofing. More particularly, the invention is a fascia cap assembly designed to limit water from moving through capillary action back towards the roof. The assembly has an elongated drip edge that displaces water away from the roof, preserving the integrity of the roof and building walls below. The assembly also contains a blocking strip to help the flow of water away from the roof and also to hold the assembly together.

BACKGROUND OF THE INVENTION

Buildings, such as houses and office buildings are made of walls and are covered by a roof. The roof is typically, but not always, downward sloping so that water can drip off the roof and away from the building.

At the point where the water drips off the edge of the roof, a fascia cap is typically installed to provide protection for the roof. The edge of the roof is the place most likely to have water accumulate and a fascia cap is designed to protect water from entering the building walls through the roof.

A disadvantage to prior art designs for fascia caps is that water is often able to seep between the fascia cap and the roof, causing rot and deterioration of the roof and building walls. Prior art fascia caps, such as the one described in U.S. Pat. No. 6,035,587 suffer from a phenomena known as capillary action, which allows water to adhere to the fascia cap and seep through and enter the roof.

Capillary action involves water moving back up the fascia cap due to surface tension. The surface tension results in water penetrating the fascia cap and entering the roof.

Along with water, dirt and other debris may enter the roof via capillary action and surface tension, whereby the water causes the dirt and debris to flow back towards the roof. As such, it important to design a fascia cap that adequately displaces water away from the roof and building and limits capillary action and surface tension from allowing water and debris to seep back into the roof. This limits and potentially prevents rot and decay of the roof and preserves the structural integrity of the roof and building as a whole.

What is desired therefore is to provide a fascia cap design and assembly that mitigates and almost entirely eliminates capillary action. It is further desirable to develop a roofing assembly with a fascia cap having a continuous elongated drip edge that works to mitigate capillary action. It is further desirable and advantageous for the fascia cap to be in one continuous piece for assembly and cost purposes. It is further desirable to have fascia cap assembly with blocking strip that reinforces and attaches the fascia cap to the roof. A method for assembling a roofing assembly having a fascia cap with an elongated drip edge is also desirable.

SUMMARY OF THE INVENTION

Accordingly, it is an object of the present invention to provide a fascia cap design and assembly that mitigates and almost entirely eliminates capillary action. It is further object of the present invention to provide a roofing assembly with a fascia cap having a continuous elongated drip edge that works to mitigate capillary action. A further object of the invention is to have the fascia cap be in one continuous piece. A further object of the invention is to have a blocking strip as part of the assembly that reinforces the fascia cap and attaches it to the roof. It is a further object of the present invention to provide a method for a roofing assembly having a fascia cap with a continuous elongated drip edge.

These and other objectives are achieved by providing a roofing assembly for the end of a roof comprising: a fascia cap having a top edge, side edge, and bottom edge, the side edge connecting the bottom edge to the top edge to form a U-shaped body, the bottom edge having a drip edge extending past the U-shaped body; a roofing material; and a shingle material, wherein the body of the fascia cap accepts the roofing material, and wherein the shingle material is adapted to lie flat against the top edge of the fascia cap. This assembly may be used on the following roof systems: TPO-RS, SBS Modified bitumen, all one-ply and BUR, and also used as fascia.

The assembly further may have the drip edge run across the length of the bottom edge and be continuous with the bottom edge. The assembly further may have the edges of the fascia cap be fused together as one piece.

In preferred embodiments, the drip edge is at least as long as the side edge. In other preferred embodiments, the drip edge is at least half as long as the side edge. In other preferred embodiments, the bottom edge is at least as long as the top edge. The assembly functions to limit water from moving through capillary action back towards the roof. The assembly mitigates surface tension allowing water to move back and up towards the roof.

The assembly may further comprise a blocking strip, the blocking strip adapted to lie on top of the shingle material. Fasteners may also be applied that secure the blocking strip to the shingle material, although fasteners are not always necessary. On the bottom surface of the blocking strip, an adhesive may be applied to secure the blocking strip to the shingle material. The adhesive on the bottom surface may heat up and solidify to adhere the blocking strip to the roof, preferably to the shingle material. The blocking strip may also contain side surfaces angled so as to limit and block water from entering the bottom surface of the blocking strip, so water will not interfere and interact with the adhesive material.

Another embodiment of the present invention involves a fascia cap comprising: a top edge, side edge, and bottom edge, the side edge connecting the bottom edge to the top edge to form a U-shaped body, and the bottom edge having a drip edge extending past the U-shaped body. The fascia cap is typically found on the end of the roof.

Furthermore, the fascia cap may have the drip edge run the length of the bottom edge and be continuous with the bottom edge. The drip edge may limit water from moving through capillary action and surface tension back towards the roof.

In another embodiment, the drip edge is at least as long as the side edge. In another embodiment, the drip edge is at least half as long as the side edge. In another embodiment, the bottom edge is at least as long as the top edge. In another embodiment, the elongated drip edge has an axial length of more than half an inch.

The body of the fascia cap may be adapted to accept a roofing material, such as insulation, shingles, wood, or other roofing materials known in the art. The edges of the fascia cap are typically fused together as one piece, through they may also be formed of separate pieces hinged or fused together.

Another embodiment of the present invention involves a method for assembly of a roofing system for the end of a roof comprising the steps of: installing a fascia cap with a top edge, side edge, and bottom edge, the side edge connecting the bottom edge to the top edge to form a U-shaped body, and the bottom edge having a drip edge extending past the U-shaped body; sliding roofing into the body of the fascia cap; and laying shingle material over the top edge of the fascia cap.

The fascia cap of the above method may have the drip edge run across the length of the bottom edge and be continuous with the bottom edge. The method may further comprise applying a blocking strip over the shingle material and adhering the blocking strip to the shingle material. The blocking strip may contain a bottom surface with an adhesive to attach the blocking strip to the shingle material.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

BRIEF DESCRIPTION OF THE DRAWINGS

FIG. 9 is a top view of a blocking strip of an embodiment of the present invention;

FIG. 10 is a bottom view of the blocking strip of FIG. 9;

FIG. 11 is a side view of the blocking strip of FIG. 9.

DETAILED DESCRIPTION OF THE INVENTION

Figure 1:
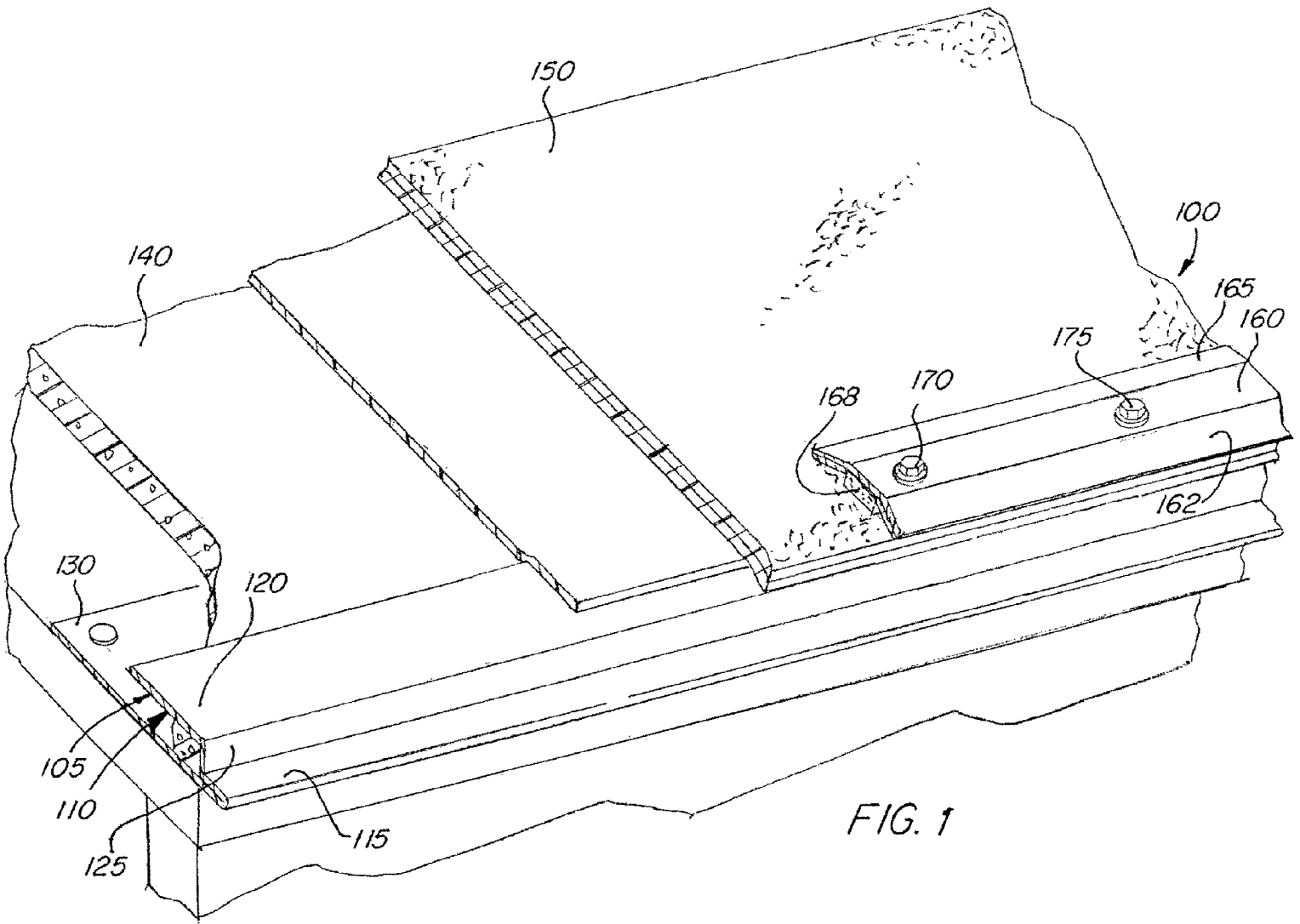
FIG. 1 is perspective view of the assembly for a roof having a fascia cap, roofing material, and shingle material connected in an assembly.

Referring to FIG. 1, an assembly 100 fitting on the end of a roof in accordance with the present invention is shown. This assembly 100 contains a fascia cap 110 having an elongated drip edge 115, top edge 120, side edge 125, and bottom edge 130. In a preferred embodiment, the fascia cap 110 is made of a single material such as a metal, metal alloy, hard plastic, or other such material used in the roofing industry. The body 105 of the fascia cap 110 is preferably a U-shape where top edge 120 and bottom edge 130 are connected by side edge 125. Bottom edge 130 has drip edge 115 extending past U-shaped body 105.

The fascia cap 110 is designed to accept a roofing material 140, such as insulation, wood, foam, or any such material that is used in the roofing and construction industry. Shingle material 150 is adapted to lay flat against the top edge of the fascia cap. Single material 150 may be standard housing shingles or other such materials designed to protect a roof from water and wear and tear of external elements.

The assembly 100 may be used on the following roof systems: TPO-RS; SBS Modified bitumen, all one-ply and BUR, and also used as fascia.

In certain embodiments, elongated drip edge 115 runs across the entire length of bottom edge 130 and is continuous with bottom edge 130. Drip edge 115 may be at least as long as side edge 125. In other embodiments, drip edge 115 may be at least half as long as side edge 125. Bottom edge 130 may be as long as top edge 120, and may be longer in certain embodiments of the invention.

In other embodiments, drip edge 115, top edge 120, side edge 125, and bottom edge 130 are fused together as one piece. This is advantageous in terms of cost of manufacturing the fascia cap as well as to limit points of entry for water.

Furthermore, fascia cap 110 is used to limit water from moving through capillary action or surface tension back towards the roof. Surface tension causes water to adhere to fascia cap 110 and causes the water to move back upward to the roof. Drip edge 115 keeps the water away from fascia cap 110 and allows the water to drip off the fascia cap 110 and away from the roof.

FIG. 1 further shows blocking strip 160 having fasteners 170 and 175. Fasteners 170/175 and blocking strip 160 function to hold roof assembly 100 together and to secure shingle material 150 to fascia cap 110 and roofing material 140.

The bottom surface of blocking strip 160 also contains adhesive 168 designed to secure blocking strip 160 to shingle material 150. This adhesive 168 may heat up and solidify to adhere and attach blocking strip 160 to shingle material 150. Blocking strip 160 also preferably has side surfaces 162 and 165 designed to limit water from entering the bottom surface of blocking strip 160, which limits water from interfering and interacting with adhesive material 168.

Figure 2:
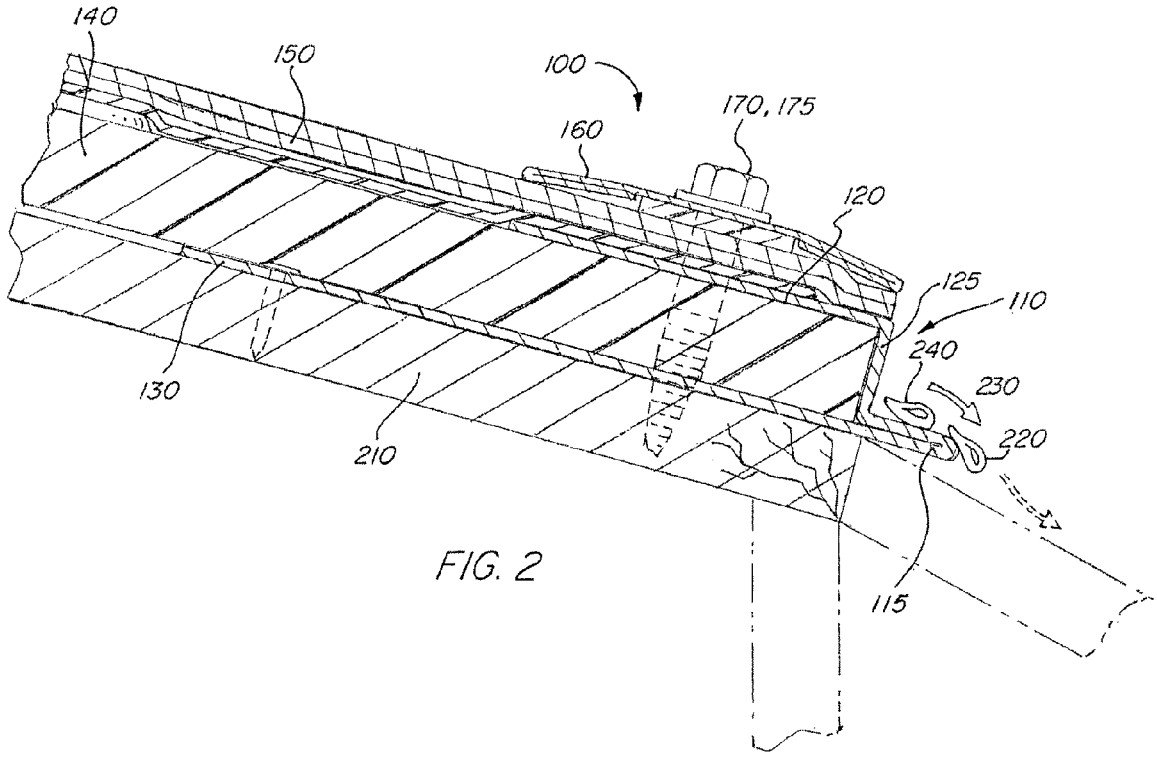
FIG. 2 is side view of the assembly of FIG. 1.

In FIG. 2, a side view of assembly 100 is presented. Fascia cap 110 is shown with drip edge 115, top edge 120, side edge 125, and bottom edge 130. Roofing material 140 is merged into U-shaped body 105 of fascia cap 110. Shingle material 150 is shown laying flat on the top edge 120 of fascia cap 110 with blocking strip 160 fastened to fascia cap via fastener 170/175. Fastener 170/175 are shown holding assembly 100 together. Lower roofing material 210 is also shown, whereby lower roofing material 210 is typically wood or other such material used to provide structural support for the building 250 (not shown).

Also drip edge 115 is shown in its elongated state. Water droplets 220, 240 are shown on drip edge 115. Water droplets 220, 240 are shown moving in a direction away from the roof namely in direction 230 shown by an arrow. This displays how drip edge 115 functions whereby it limits capillary action and causes water and water droplets 220, 240 to drip away from the roof.

Stopping capillary action is important as it preserves the structural integrity of the roof as well as limits water from seeping into the space between a fascia cap and the roofing material.

Figure 3:
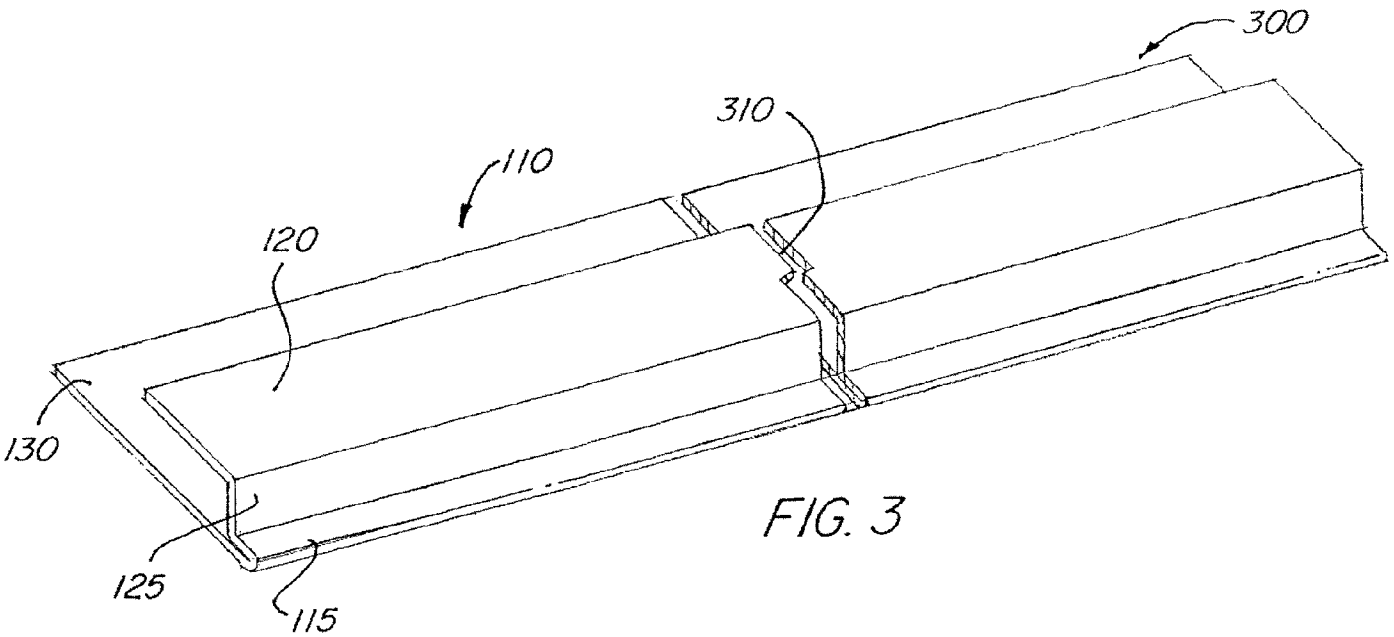
FIG. 3 is a perspective view of a fascia cap of an embodiment of the present invention.

FIG. 3 shows the fascia cap, specifically fascia cap 110 having top edge 120, side edge 125, bottom edge 130, and drip edge 115 extending past bottom edge 130. Fascia cap 110 can be linked together with another fascia cap 300 via locking mechanism 310. This allows multiple fascia caps to be linked together to cover the length of a roof, so that the entire edge of the roof can be covered if it is longer than individual fascia caps. Furthermore, other embodiments of the present invention allow for different locking mechanisms 310 than the ones shown in FIG. 3.

Figure 5:
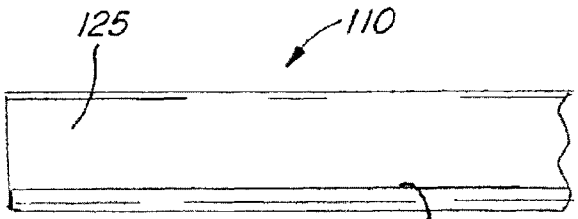
FIG. 5 is a front view of the fascia cap of FIG. 3.
Figure 4:
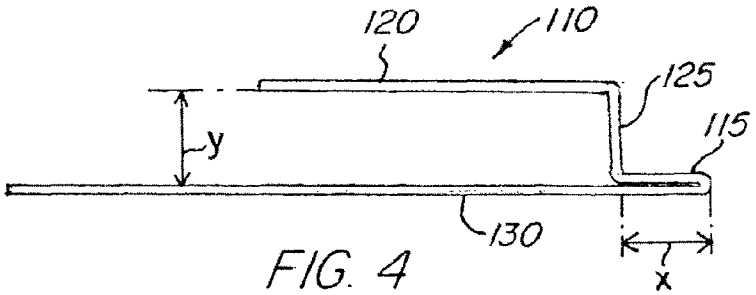
FIG. 4 is a side view of the fascia cap of FIG. 3.

FIGS. 4 and 5 show a side view and front view of fascia cap 110, respectively. Top edge 120, side edge 125, bottom edge 130, and drip edge 115 are displayed and fused together as one piece.

In FIG. 4, one can see drip edge 115 measured along length x and side edge 125 measured along length y. Length y is the diameter between the inner surface of top edge 120 and bottom edge 130, which is the length of side edge 125. Length x is the distance from the end of drip edge 115 to the part where side edge 125 meets drip edge 115. As shown drip edge 115 is as least half as long as side edge 125. In other embodiments, drip edge 115 may be at least as long as side edge 125. The longer the drip edge, the farther away the water is from the roof and the more difficult it would be for water to seep back towards the fascia cap and roof.

Figure 6:
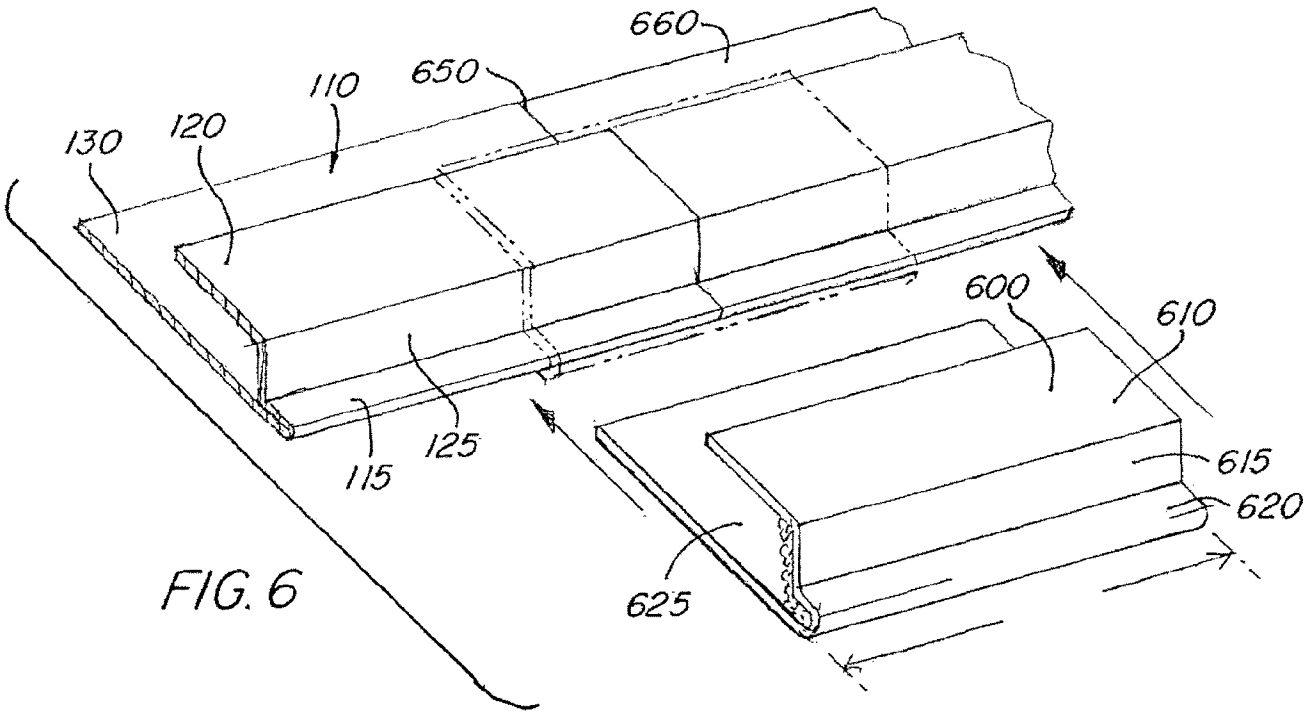
FIG. 6 is a perspective view of a fascia cap of another embodiment of the present invention.

FIG. 6 shows a perspective view of a fascia cap 600 of another embodiment of the present invention. Fascia cap 600 has top edge 610, side edge 615, drip edge 620, and bottom edge 625. Drip edge 620 extends past side edge 615.

Fascia cap 600 is designed lay on top of and accept fascia cap 110. This allows fascia cap 600 to cover seem/opening 650 which occurs as a result of fascia caps 110 and 660 being placed side-by-side. When two fascia caps are placed side-by-side, seem 650 results, which can allow water to drip inside the seam and potentially enter the fascia cap and roof. The design of fascia cap 600 allows fascia cap 110 and/or 660 to accept fascia cap 600 and cover seem 650, preventing water from entering the roof.

Figure 8:
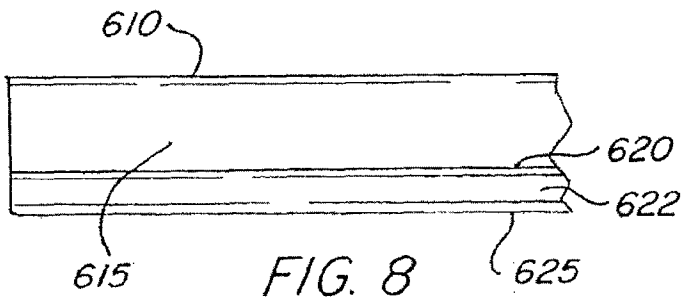
FIG. 8 is a front view of the fascia cap of FIG. 6.
Figure 7:
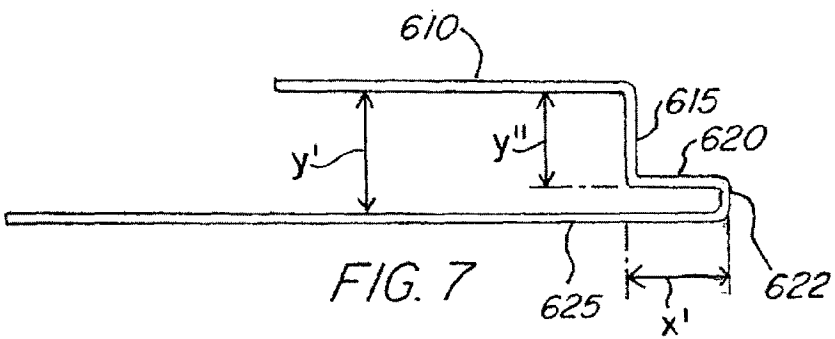
FIG. 7 is a side view of the fascia cap of FIG. 6.

As shown in FIGS. 7 and 8, fascia cap 600 has top wall 610, side wall 615, drip edge 620, and bottom wall 625. Drip edge 620 has a side wall 622 whereby drip edge 620 can fit around drip edge 115 of fascia cap 110. This allows fascia cap 110 to fit inside fascia cap 600.

FIG. 7 also shows the length of drip edge 620 represented by x'. y' is the diameter between the inner surface of top edge 610 and bottom edge 625. In the embodiment shown y" is the length of side edge 615. As shown drip edge 620 is as least half as long as side edge 615. In other embodiments, drip edge 620 may be at least as long as side edge 615. The longer the drip edge, the farther away the water is from the roof and the more difficult it would be for water to seep back towards the fascia cap and roof FIGS. 9-11 show blocking strip 900, which is equivalent to blocking strip 160 shown in FIG. 1. Blocking strip 900 has side walls 910 and 930, top wall 920, which has holes 950, 952, 955, and 958 for accepting fasteners (not shown). Adhesive material 940 is shown on the bottom of blocking strip 900.

Adhesive material 940 is made of housing material 1100 with sticky material 1110 attached to housing material 1100. Sticky material 1110 connects blocking strip 900 to shingle material 150 (not shown). Sticky material 1110 can heat up and solidify to adhere and attach blocking strip 900 to shingle material 150.

Blocking strip 900 also contains side walls 910, 930, which contain bottom side walls 1020 and 1010 respectively. These walls limit water from entering the bottom of blocking strip 900, and prevent water from interfering with adhesive material 940.

Another embodiment of the present invention involves a method for assembly 100 of a roofing system for the end of a roof comprising the steps of: installing a fascia cap 110 with a top edge 120, side edge 125, and bottom edge 130, wherein side edge 125 connects bottom edge 130 to top edge 120 to form U-shaped body 105, bottom edge 130 having drip edge 115 extending past U-shaped body 105; sliding roofing 140 into body 105 of fascia cap 110; and laying shingle material 150 over top edge 120 of fascia cap 110.

The method further may have drip edge 115 run across the length of bottom edge 130 and be continuous with bottom edge 130. A blocking strip 160 may further be applied over shingle material 150, adhering blocking strip 160 to shingle material 150. Blocking strip 160 contains a bottom surface with an adhesive to attach blocking strip 160 to shingle material 150.

While the invention has been specifically described in connection with certain specific embodiments thereof, it is to be understood that this is by way of illustration and not of limitation and that various changes and modifications in form and details can be made thereto, and the scope of the appended claims should be construed as broadly as the prior art will permit.

The description of the invention is merely exemplary in nature, and thus, variations that do not depart from the gist of the invention are intended to be within the scope of the invention. Such variations are not to be regarded as a departure from the spirit and scope of the invention.

What is claimed is:

1. A roofing assembly for the end of a roof having roofing material and shingle material comprising:

a fascia cap having a top edge, side edge, and bottom edge, the side edge connecting the bottom edge to the top edge to form a U-shaped body, the bottom edge having a drip edge extending past the U-shaped body, the drip edge running across the length of the bottom edge and being continuous with the bottom edge, wherein the drip edge and the bottom edge are coplanar, wherein the body of the fascia cap accepts the roofing material, and wherein the shingle material lies flat against the top edge of the fascia cap, and wherein the drip edge is at least as long as the side edge, and wherein the bottom edge is longer than the top edge.

2. The assembly of claim 1, wherein the edges of the fascia cap are fused together as one piece.

3. The assembly of claim 1, wherein the fascia cap prevents water from moving through capillary action back towards the roof.

4. The assembly of claim 1, further comprising a blocking strip, the blocking strip adapted to lie on top of the shingle material.

5. The assembly of claim 4, further comprising fasteners that secure the blocking strip to the shingle material.

6. The assembly of claim 4, wherein the bottom surface of the blocking strip has an adhesive to secure the blocking strip to the shingle material.

7. The assembly of claim 6, wherein the adhesive on the bottom surface of the blocking strip heats up and solidifies to adhere the blocking strip to the shingle material.

8. The assembly of claim 4, wherein the blocking strip contains side surfaces angled so as to prevent water from entering the bottom surface of the blocking strip.

9. The assembly of claim 1, wherein the drip edge limits water from moving through capillary action back up towards the roof.

10. A method for assembly of a roofing system for the end of a roof comprising:

installing a fascia cap with a top edge, side edge, and bottom edge, the side edge connecting the bottom edge to the top edge to form a U-shaped body, and the bottom edge having a drip edge extending past the U-shaped body, wherein the drip edge runs across the length of the bottom edge and is continuous with the bottom edge, wherein the drip edge is at least as long as the side edge, wherein the drip edge and the bottom edge are coplanar, and wherein the bottom edge is longer than the top edge;

sliding roofing into the body of the fascia cap; and laying shingle material over the top edge of the fascia cap.

11. The method of claim 10, further comprising applying a blocking strip, over the shingle material and adhering the blocking strip to the shingle material.

12. The method of claim 11, wherein the blocking strip contains a bottom surface with an adhesive to attach the blocking strip to the shingle material.

13. The method of claim 10, wherein the drip edge limits water from moving through capillary action back up towards the roof.

* * * * *